US007432862B2

(12) United States Patent
Heyde

(10) Patent No.: US 7,432,862 B2
(45) Date of Patent: Oct. 7, 2008

(54) BROADBAND PATCH ANTENNA

(75) Inventor: Wolfgang Heyde, Herisau (CH)

(73) Assignee: Huber + Suhner AG, Herisau (CH)

( * ) Notice: Subject to any disclaimer, the term of this patent is extended or adjusted under 35 U.S.C. 154(b) by 0 days.

(21) Appl. No.: 11/566,265

(22) Filed: Dec. 4, 2006

(65) Prior Publication Data

US 2007/0229359 A1 Oct. 4, 2007

Related U.S. Application Data

(63) Continuation of application No. PCT/CH2005/000319, filed on Jun. 7, 2005.

(30) Foreign Application Priority Data

Jun. 23, 2004 (CH) ..... 1060/04

(51) Int. Cl.
*H01Q 1/38* (2006.01)

(52) U.S. Cl. ..... 343/700 MS; 343/846

(58) Field of Classification Search ..... 343/700 MS, 343/702, 846

See application file for complete search history.

(56) References Cited

U.S. PATENT DOCUMENTS 4,242,685 A 12/1980 Sanford
6,856,819 B2 * 2/2005 Itoh ..... 455/575.7
6,903,687 B1 * 6/2005 Fink et al. ..... 343/700 MS

FOREIGN PATENT DOCUMENTS

FR 2 842 025 A1 1/2004
SE WO 01/41256 A1 6/2001

OTHER PUBLICATIONS

G.Z. Rafi, et al., "*Radar Cross Section of Cross-Shaped Microstrip Patch Antennas*," EMC—A Global Concern. IEEE 1995 International Symposium on Electromagnetic Compatibility. Atlanta, Aug. 14-18, 1995, International Symposium on Electromagnetic Compatibility, New York, IEEE, US, Aug. 14, 1995 pp. 303-307, XP000595996.

Jui-Ching Cheng, et al., "*Theoretical Modeling of Cavity-Backed Patch Antennas Using a Hybridtechnique*," IEEE Transactions on Antennas and Propagation, IEEE Inc. New York, US, vol. 43, No. 9, Sep. 1, 1995, pp. 1003-1013, XP000522593.

F. Abboud, et al., "*Accurate Model for the Input Impedance of Coax-Fed Rectangular Microstrip Antenna with and without Airgaps*," Universite De Nice, France, 1989, pp. 102-106, XP 006517741.

* cited by examiner

*Primary Examiner*—Hoang V Nguyen
(74) *Attorney, Agent, or Firm*—Burr & Brown

(57) ABSTRACT

A broadband patch antenna including a planar metallic patch sheet that is provided with right-angled edges and is disposed at a predetermined first height above and parallel to the planar base area of an electrically conducting reflector, and a device for feeding an RF signal into the metallic patch sheet. The feeding device encompasses a conductor which is guided in a vertical direction and is insulated through the base area of the reflector and terminates at a feeding point on the metallic patch sheet. To significantly improve the broadband range while keeping the structure of the antenna simple, the metallic patch sheet has the shape of a cross and the conductor of the feeding device is an inner conductor of a coaxial conductor that is positioned between the base area of the reflector and the metallic patch sheet.

19 Claims, 3 Drawing Sheets

BROADBAND PATCH ANTENNA

CROSS REFERENCE TO RELATED APPLICATION

This application is a continuation of International Application No. PCT/CH2005/000319, having an international filing date of Jun. 7, 2005, and claims the benefit under 35 USC §119(a)-(d) of Swiss Application No. 1060/04, filed Jun. 23, 2004, the entireties of which are incorporated herein by reference.

FIELD OF THE INVENTION

The present invention relates to the field of antenna technology, and relates in particular to a broadband patch antenna that includes a planar patch plate with a rectangular rim that is at a predetermined first height above and parallel to a planar base surface of an electrically conductive reflector, and an RF signal feed apparatus for feeding an RF signal into the patch plate.

BACKGROUND OF THE INVENTION

The applications of wire-free communication techniques have actually been increasing almost exponentially in the last two decades. This has now led to both speech services and data services being transmitted in frequency bands including, the 400, 800, 900, 1800 and 1900 MHz bands, which are available worldwide for mobile speech transmission. This frequency range has been extended to 2170 MHz with the introduction of UMTS Standard (Universal Mobile Telecommunication System). As an alternative to landline telephony, the frequency range between 3400 and 3600 MHz, keyword WLL (Wireless Local Loop), has been released in various European countries in previous years. In addition, transmission of high data rates can now be done without the use of wires, using the WLAN frequencies (Wireless Local Area Network). The frequencies released for these applications are in the 2.4 and 5.5 GHz range.

In order to supply all of these services efficiently to an in-house area, such as commercial buildings, airports, railroad stations, underground garages and hotels, an entire forest of antennas would be necessary if individual antennas were to operate exclusively in each relevant frequency band. However, a forest of antennas such as this is highly complex in terms of the space required, installation and operation. Thus, it is desirable to minimize this forest of antennas as far as possible by the use of particularly broadband antennas. One shape which is particularly suitable by virtue of its simplicity is the patch antenna, in which a patch plate, which is arranged above a conductive base surface, is used as an antenna element. In contrast to a monopole antenna, this concentrates the emitted energy in a smaller spatial angle.

Patch antennas have been described in numerous documents and articles (see, for example, the "Microstrip Antenna Design Handbook", Artech House, Boston London, 2001, pages 8-9 and 16-17). Patch antennas are distinguished by their flat design, which can be produced at low cost. Various basic shapes of patch antennas can also be found in U.S. Pat. No. 6,317,084. One important disadvantage of patch antennas in comparison to other antenna shapes is, however, that their bandwidth is relatively narrow. A patch antenna typically results in bandwidth ratios of 1:1.2 for a VSWR (Voltage Standing Wave Ratio) of <2. Extensive efforts have therefore already been made in the past to widen the bandwidth of patch antennas. Some of the solutions proposed for this purpose are quoted and discussed in the introductory part (columns 1-3) of U.S. Pat. No. 6,317,084, but lead to comparatively complex antenna structures, without being able to comply completely with the broad bandwidth requirements.

SUMMARY OF THE INVENTION

The object of the invention is therefore to develop a simple patch antenna which as far as possible covers the frequency range from 800 to 6000 MHz and is suitable for use in the in-house field.

In accordance with one embodiment of the present invention, the patch plate is provided in the form of a cross, and the conductor of the feed apparatus is provided in the form of an inner conductor of a coaxial conductor between the base surface of the reflector and the patch plate. The specific cruciform shape of the patch plate interacts with the geometry of the coaxial feed to achieve an extremely broad bandwidth, so that the antenna covers a bandwidth ratio of 1:3 with a VSWR (Voltage Standing Wave Ratio) of <2, and at the same time can be produced very easily.

In a preferred embodiment of the broadband patch antenna according to the present invention: (1) the patch plate originates from a rectangular basic shape with a rectangular cutout at each of the four corners of the rectangle, (2) the patch plate is mirror-image symmetrical with respect to a center line, (3) the feed point is located on the center line, and (4) the rectangular cutouts have the same width transversely with respect to the center line.

It has been found to be particularly advantageous for the rectangular basic shape of the patch plate to have a width of 0.58 $\lambda_u$ and a length of 0.465 $\lambda_u$, when the rectangular cutouts each have a width (W2, W3) of 0.165 $\lambda_u$ and a length of 0.11 $\lambda_u$ or 0.055 $\lambda_u$, and the predetermined first height (H) is 0.08 $\lambda_u$ where $\lambda_u$ is the wavelength of the lower operating frequency of the antenna.

In another embodiment of the broadband patch antenna according to the present invention, the size of the base surface of the reflector is chosen such that the vertical projection of the patch plate onto the base surface is located entirely within the base surface. In this embodiment, it is also preferred that the base surface is square the base surface of the reflector has an edge length of 0.66 $\lambda_u$, where $\lambda_u$ is the wavelength of the lower operating frequency of the antenna, the reflector has side walls, which are at right angles to the base surface and surround the patch plate at the sides, and the height of the side walls are equal to the predetermined first height of the patch plate above the base surface of the reflector.

The reflector and the patch plate are preferably composed of an electrically highly conductive metal sheet, in particular composed of copper, aluminum or brass, and the metal sheet has a thickness which is substantially greater than the penetration depth of the skin effect at the intended operating frequency.

In one embodiment, electrically insulating spacers, which are arranged in a distributed manner, are provided in order to maintain the predetermined first height of the patch plate above the base surface of the reflector.

In another embodiment, instead of the spacers, an intermediate layer composed of a dielectric, for example a plastic foam, is provided to maintain the predetermined first height of the patch plate above the base surface of the reflector.

Another aspect of the present invention is that the patch plate can be conductively shorted to the reflector at one or more points by means of electrically conductive connection elements without any adverse effect on the antenna characteristics.

In another embodiment of the present invention, the inner conductor of the coaxial conductor is surrounded by an electrically conductive hollow cylinder, starting from the base surface of the reflector, to a predetermined second height, which is less than the predetermined first height. In this embodiment, the external diameter of the hollow cylinder is 0.052 $\lambda_u$ and the predetermined second height is 0.052 $\lambda_u$, where $\lambda_u$ is the wavelength of the lower operating frequency of the antenna.

Further embodiments are specified in the dependent claims.

BRIEF DESCRIPTION OF THE DRAWINGS

The invention will be explained in more detail in the following text with reference to exemplary embodiments and in conjunction with the drawing, in which.

DETAILED DESCRIPTION OF THE INVENTION

Figure 1:
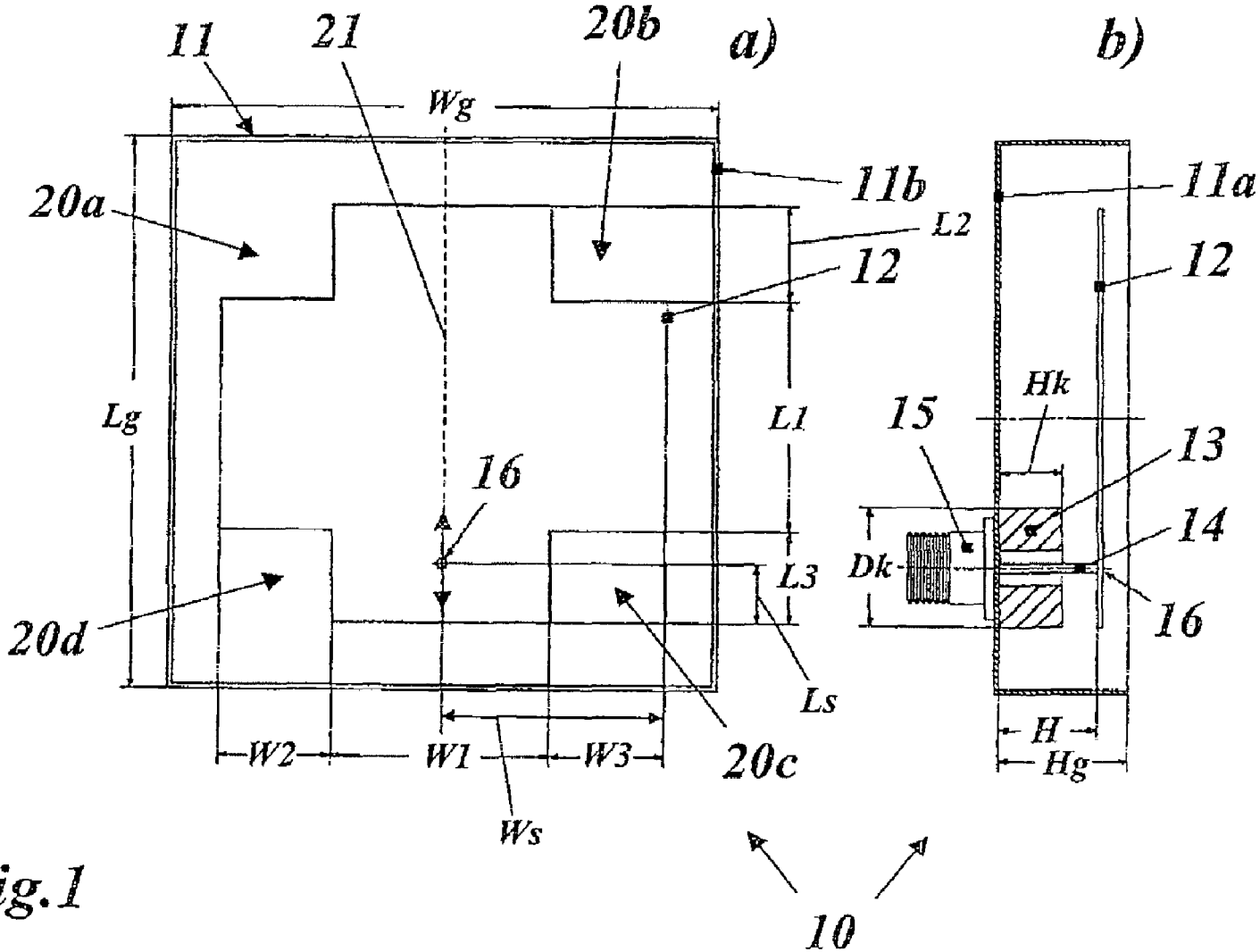
FIG. 1 is a plan view from above (FIG. 1*a*) and a cross section (FIG. 1*b*) of a first embodiment of a broadband patch antenna according to the present invention.

FIG. 1 is a plan view from above (FIG. 1*a*) and a cross section (FIG. 1*b*) of a first embodiment of a broadband patch antenna according to the present invention. The broadband patch antenna 10 essentially comprises a box-shape reflector 11, which is open on one side, a patch plate 12 which is arranged in the interior of the reflector 11 and has a feed point 16, and a coaxial feed apparatus 13, 14, 15, by which RF power can be passed from the outside to the patch plate 12.

The electrically conductive reflector 11 has a rectangular, planar base surface 11*a* with a width, Wg, and a length, Lg. In the illustrated exemplary embodiment, the base surface 11*a* is square (Lg=Wg). At the sides, the base surface merges into vertical side walls 11*b*, which have a uniform height, Hg. The planar patch plate 12 is arranged parallel to the base surface 11*a*, at a height H above the base surface 11*a* and parallel to it. The base surface 11*a* of the reflector 11 is larger than the surface of the patch plate 12, so that the vertical projection of the patch plate 12 is located entirely within the base surface 11*a*, and the patch plate 12 is at an adequate distance from the surrounding side walls 11*b*.

The patch plate 12 is in the form of a cross with a rectangular edge contour. The cruciform shape is produced by rectangular cutouts 20*a*, . . . , *d* in the corners of the rectangle—starting from a rectangular base shape with the external dimensions (W1+W2+W3)×(L1+L2+L3), and whose sides run parallel to the sides of the base surface 11*a*. The patch plate 12 with its cutouts 20*a*, . . . , *d* is preferably mirror-image symmetrical with respect to a center line 21 on which the feed point 16 is arranged, and can be moved for adaptation of the antenna characteristics (double-headed arrow in FIGS. 1-3). The cutouts 20*a*, . . . , *d* have dimensions (width×length) of W2×L2, W3×L2, W3×L3 and W2×L3. The distance from the feed point 16 to the right-hand outer edge of the patch plate 12 is Ws, and its distance from the lower outer edge of the patch plate 12 is Ls.

The patch plate 12 is fed via a (coaxial) RF connector 15, which is positioned on the lower face of the reflector base surface 11*a*, whose central conductor is passed as the inner conductor 14 through the base surface 11*a* to the feed point 16 on the patch plate 12. Starting from the base surface 11*a*, the inner conductor 14 is coaxially surrounded up to a height Hk by an electrically conductive hollow cylinder 13 whose external diameter is Dk, so that, together with the hollow cylinder 13, it forms a coaxial line.

All of the materials (reflector 11, patch plate 12, etc.) must be electrically highly conductive. Copper, aluminum or brass are preferably used. In order to keep the electrical losses as low as possible, the thicknesses of the parts used should be substantially greater than the penetration depth of the skin effect at the operating frequency. Since the reflector 11 has to ensure the mechanical robustness of the antenna, it is preferably produced from sheet aluminum.

Figure 2:
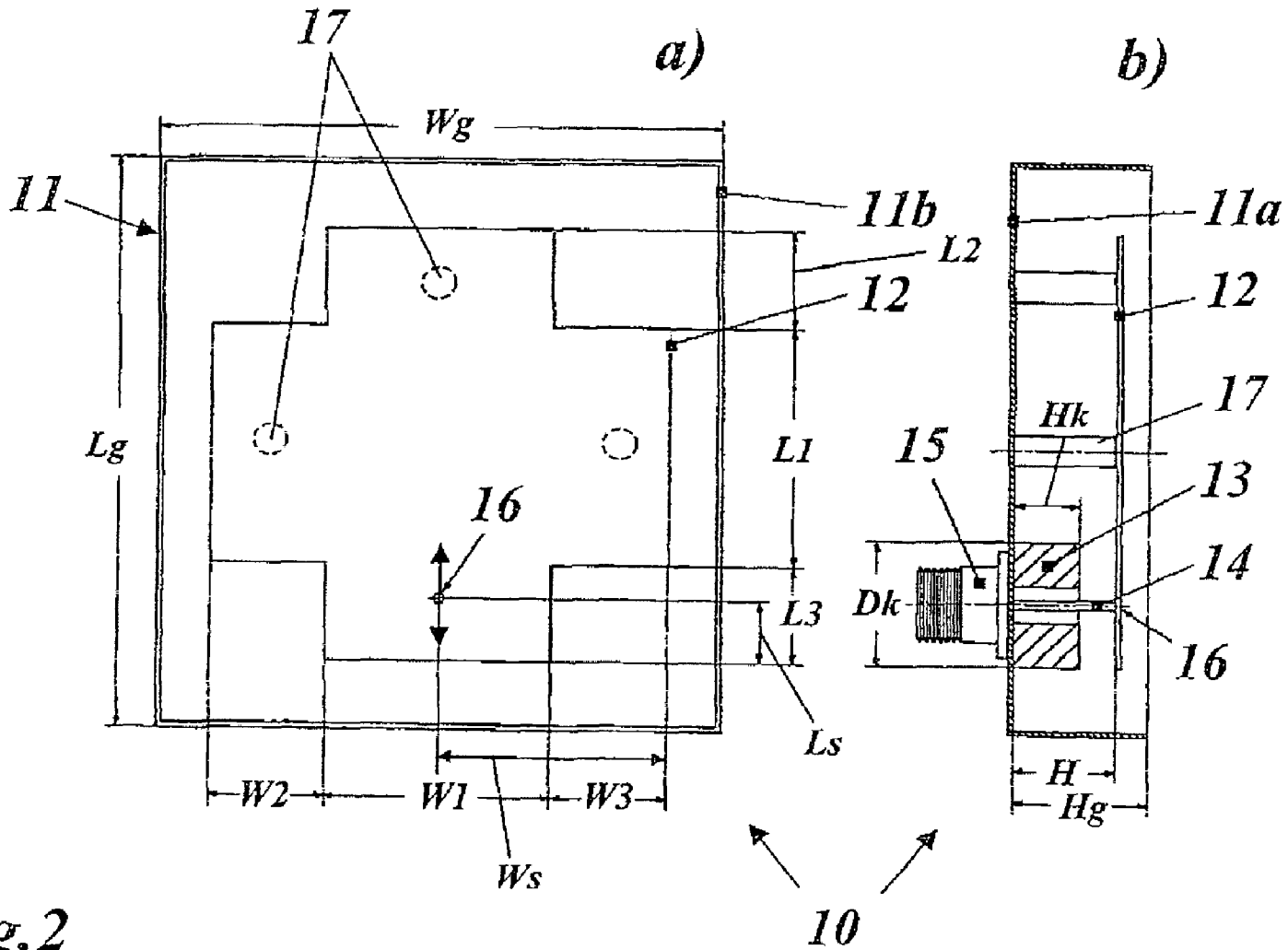
FIG. 2 is an illustration of a second embodiment of a broadband patch antenna according to the present invention, with distributed connection elements and spacers between the reflector base surface and the patch plate.
Figure 3:
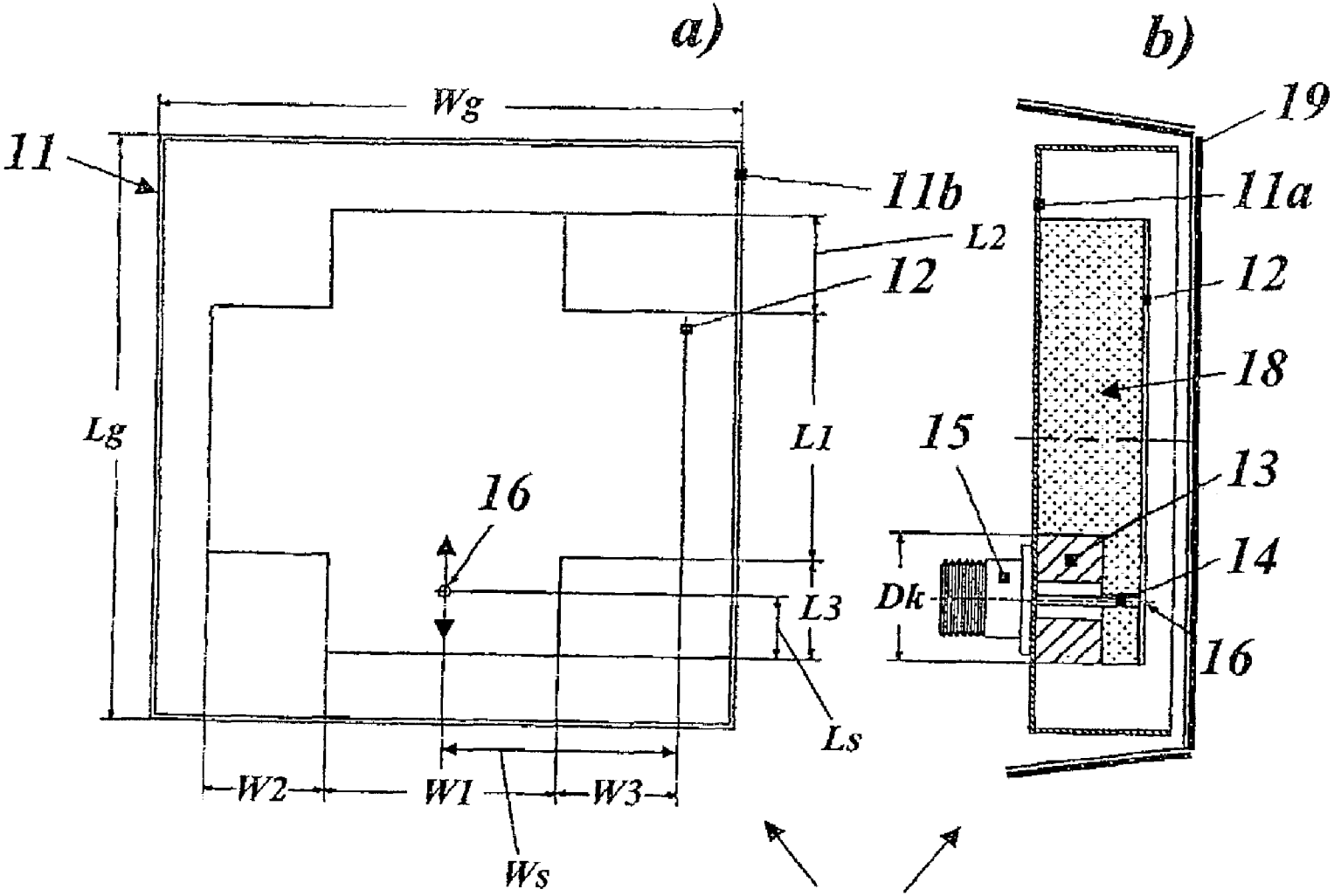
FIG. 3 is an illustration of a third embodiment of a broadband patch antenna according to the present invention, with a dielectric intermediate layer between the reflector base surface and the patch plate, and with a protective shroud.

As shown in FIG. 2, the patch plate 12 can be positioned with respect to the reflector 11 by means of spacers 17, which are composed of plastic and distributed to support the patch plate 12 with respect to the reflector 11. However, in another embodiment of the present invention, a fixed intermediate layer 18 composed of foamed plastic or the like, is provided, which acts as a dielectric between the base surface 11*a* of the reflector 11 and the patch plate 12, as shown in FIG. 3.

In another embodiment, the patch plate 12 can be conductively shorted to the reflector 11 at one or more points by means of a connection element 17 in the form of a metallic bolt, without adversely affecting the electrical operation of the antenna.

The following dimensions are advantageous for matching of the broadband patch antenna to a 50 ohm impedance system, for the wavelength $\lambda_u$ at the lower operating frequency ($\lambda_u$=c/f, c=speed of light, f=frequency):

$Dk=0.12\lambda_u$
$H=0.08\lambda_u$
$Hg=H$
$Hk=0.052\lambda_u$
$Wg=Lg=0.66\lambda_u$
$W1=0.25\lambda_u$
$W2=W3=0.165\lambda_u$
$L1=0.3\lambda_u$
$L2=0.11\lambda_u$
$L3=L2/2$,
$Ls=L3$
$Ws=(W1+W2+W3)/2$.

The input impedance of the antenna can be matched to values of <50 ohm or >50 ohm by movement of the feed point 16 in the direction of the center point or toward the edge of the patch plate 12.

FIG. 3*b* shows a protective shroud 19, which provides external protection for the antenna elements 11 and 12. This ensures that (1) the electromagnetic radiation can emerge with as little impediment as possible from the antenna, (2) people cannot directly touch live metal surfaces and, (3) the antenna is protected against weather influences and environmental influences. The protective shroud is generally made of plastic, and is placed over the antenna.

Based on the fundamental broadband design illustrated in FIGS. 1 to 3, it is, of course, additionally possible to make use of all the methods known from the prior art in order to further widen the bandwidth.

LIST OF REFERENCE SYMBOLS

10 Broadband patch antenna
11 Reflector

11*a* Base surface (reflector)
11*b* Side wall (reflector)
12 Patch plate
13 Hollow cylinder
14 Inner conductor
15 RF connector (for example SMA)
16 Feed point
17 Connection element (spacer)
18 Intermediate layer (dielectric, for example plastic foam)
19 Protective shroud
20*a*, . . . , *d* Cutout
21 Center line
Dk Diameter
H, Hg, Hk Height
Lg, L1, . . . , L3 Length
Wg, W1, . . . , W3 Width

What is claimed:

1. A broadband patch antenna comprising:

a planar patch plate with a rectangular rim, which is arranged at a predetermined first height above and parallel to a planar base surface of an electrically conductive reflector, and an RF signal feed apparatus for feeding an RF signal into said patch plate, said RF signal feed apparatus having a conductor which is insulated from and passes through said base surface of said reflector at substantially a right angle and ends at a feed point on said patch plate, wherein said patch plate is in the form of a cross, said conductor of said feed apparatus is an inner conductor of a coaxial conductor between said base surface of said reflector and said patch plate, and said broadband patch antenna is protected by a non-electrically conductive protective shroud.

2. The broadband patch antenna of claim 1, wherein said patch plate comprises a rectangular basic shape and a rectangular cutout at each of the four corners of said rectangular basic shape.

3. The broadband patch antenna of claim 2, wherein said patch plate is mirror-image symmetrical with respect to a center line, and said feed point is located on said center line.

4. The broadband patch antenna of claim 3, wherein said rectangular cutouts have the same width transversely with respect to said center line.

5. The broadband patch antenna of claim 2, wherein said rectangular basic shape of said patch plate has a width of 0.58 $\lambda_u$ and a length of 0.465 $\lambda_u$, where $\lambda_u$ is the wavelength of the lower operating frequency of the antenna.

6. The broadband patch antenna of claim 5, wherein said rectangular cutouts each have a width of 0.165 $\lambda_u$ and a length of one of 0.11 $\lambda_u$ and 0.055 $\lambda_u$, where $\lambda_u$ is the wavelength of the lower operating frequency of the antenna.

7. The broadband patch antenna of claim 1, wherein said predetermined first height is 0.08 $\lambda_u$ where $\lambda_u$is the wavelength of the lower operating frequency of the antenna.

8. The broadband patch antenna of claim 1, wherein a size of said base surface of said reflector is chosen such that the vertical projection of said patch plate onto said base surface is located entirely within said base surface and said base surface is square.

9. The broadband patch antenna of claim 8, wherein said base surface of said reflector has an edge length of 0.66 $\lambda_u$ in each case, where $\lambda_u$ is the wavelength of the lower operating frequency of the antenna.

10. The broadband patch antenna claim 8, wherein said reflector has side walls, which are at right angles to said base surface and surround said patch plate at the sides.

11. The broadband patch antenna of claim 10, wherein a height of said side walls is equal to said predetermined first height of said patch plate above said base surface of said reflector.

12. The broadband patch antenna of claim 1, wherein said reflector and said patch plate are composed of an electrically highly conductive metal sheet, and said metal sheet has a thickness which is substantially greater than the penetration depth of the skin effect at the intended operating frequency.

13. The broadband antenna of claim 12, wherein said highly conductive metal sheet is selected from the group consisting copper, aluminum and brass.

14. The broadband patch antenna of claim 1, further comprising electrically insulating spacers arranged in a distributed manner to maintain said predetermined first height of said patch plate above said base surface of said reflector.

15. The broadband patch antenna of claim 1, further comprising an intermediate layer composed of a dielectric provided to maintain said predetermined first height of said patch plate above the base surface of said reflector.

16. The broadband patch antenna of claim 1, wherein said patch plate is conductively shorted to said reflector at one or more points by means of electrically conductive connection elements.

17. The broadband patch antenna claim 1, wherein said inner conductor originates from a coaxial RF connector on a lower face of said base surface of said reflector.

18. A broadband patch antenna comprising:

a planar patch plate with a rectangular rim, which is arranged at a predetermined first height above and parallel to a planar base surface of an electrically conductive reflector, and an RF signal feed apparatus for feeding an RF signal into said patch plate, said RF signal feed apparatus having a conductor which is insulated from and passes through said base surface of said reflector at substantially a right angle and ends at a feed point on said patch plate, wherein said patch plate is in the form of a cross, said conductor of said feed apparatus is an inner conductor of a coaxial conductor between said base surface of said reflector and said patch plate, and wherein said inner conductor of said coaxial conductor is surrounded by an electrically conductive hollow cylinder.

19. A broadband patch antenna comprising:

a planar patch plate with a rectangular rim, which is arranged at a predetermined first height above and parallel to a planar base surface of an electrically conductive reflector, and an RF signal feed apparatus for feeding an RF signal into said patch plate, said RF signal feed apparatus having a conductor which is insulated from and passes through said base surface of said reflector at substantially a right angle and ends at a feed point on said patch plate, wherein said patch plate is in the form of a cross, said conductor of said feed apparatus is an inner conductor of a coaxial conductor between said base surface of said reflector and said patch plate, said inner conductor of said coxial conductor is surrounded by an electrically hollow cylinder, and said hollow cylinder surrounds said inner conductor from said base surface of said reflector to a predetermined second height, which is less than said predetermined first height, and an external diameter of said hollow cylinder is 0.052 $\lambda_u$, and said predetermined second height is 0.052 $\lambda_u$, where $\lambda_u$ is the wavelength of the lower operating frequency of the antenna.

* * * * *